United States Patent [19]

Miller et al.

[11] 4,422,833

[45] Dec. 27, 1983

[54] PNEUMATIC TRANSFER SYSTEM AND A FLUID FLOW CONTROL DEVICE THEREFOR

[75] Inventors: David L. W. Miller, Knoxville; Billy P. Freeman, Blaine, both of Tenn.

[73] Assignee: Free Flow, Inc., Blaine, Tenn.

[21] Appl. No.: 262,121

[22] Filed: May 11, 1981

[51] Int. Cl.[3] ..... F04F 5/20; F04F 5/52

[52] U.S. Cl. ..... 417/183; 137/205; 417/186; 417/188; 417/197

[58] Field of Search ..... 137/891, 892, 205; 417/162, 181, 182, 183, 186, 188, 197

[56] References Cited

U.S. PATENT DOCUMENTS

| | | | |
|---|---|---|---|
| 399,715 | 3/1889 | Wheeler | 417/188 X |
| 1,453,513 | 5/1923 | Metz | 417/186 |
| 1,458,523 | 6/1923 | Coutant | 417/183 |
| 2,019,968 | 11/1935 | Holloway | 417/183 |
| 2,524,559 | 10/1950 | Campbell | 417/197 |
| 2,594,962 | 4/1952 | McDonald | 417/183 |
| 2,602,398 | 7/1952 | Nittka | 417/197 X |
| 2,676,575 | 4/1954 | Rosenberger | 417/183 |
| 3,435,850 | 4/1969 | Male . | |
| 3,625,404 | 12/1971 | Probst . | |
| 3,799,195 | 3/1974 | Hermans | 137/891 X |

FOREIGN PATENT DOCUMENTS

| | | | |
|---|---|---|---|
| 515188 | 12/1971 | Switzerland | 137/891 |

*Primary Examiner*—Robert G. Nilson

[57] ABSTRACT

A fluid flow control device includes a first fluid flow passageway, a fluid inlet into the first passageway, a fluid outlet from the first passageway, a second fluid flow passageway in flow communication with the first passageway, and a fluid flow-through opening in fluid flow communication with the second passageway. The fluid flow control device is controlled to selectively provide, alternatively, a vacuum or a pressure condition at the flow-through opening. A pneumatic transfer system is also disclosed for alternately transferring a batch of particulate material from a storage area to a batching vessel, and for transferring the particulate material from the batching vessel to a remote location. The system includes a single blower having its high pressure side in flow communication with the fluid flow control device for selectively providing both vacuum and pressure conditions in the batching vessel to effect the selected transferring of particulate material into and out of the batching vessel. A gas separation filter device is provided for separating particulate material from the conveying fluid when the batching vessel is being filled, and which is back flushed of entrained particulate material when the batching vessel is being emptied.

11 Claims, 7 Drawing Figures

PNEUMATIC TRANSFER SYSTEM AND A FLUID FLOW CONTROL DEVICE THEREFOR

The invention relates to pneumatic control devices and systems, and more particularly to a fluid flow control device for selectively providing vacuum or pressure conditions, a pneumatic system for transferring particulate material, selectively, to and from a vessel, and a particulate material gas separation filter device for separating particulate material from the conveying fluid.

Pneumatic transfer systems are presently used in numerous applications for conveying particulate material between remote locations and are used to advantage for filling and emptying vessels with a particulate material. Pneumatic transfer systems are useful in conveying any number of various types of particulate material such as, for example, salt, grain, fertilizer, cement, sand and carbon. As a result, many diverse industries utilize pneumatic transfer systems as an indespensible component in their processes.

The heretofore known pneumatic transfer systems are limited or have various deficiencies. Some systems require a reversible pump or blower for selectively pressurizing and depressurizing the system. Others require a piping system having branches connected to both the suction side and pressure side of a pump with numerous valves in the piping system to selectively control the flow of fluid from the suction side and pressure side of the pump. Certain other systems rely on the natural flow characteristics of particulate material being transferred and are, thus, limited in application.

Various fluid flow control devices are known for controlling fluid flow in, for example, a pneumatic transfer system. Some of these control devices are valves used to alternately route the flow of fluid along different paths. Yet others are flow dividers which divide the incoming fluid flow into two or more outlets from the valve. In pneumatic systems, a plurality of heretofore known flow control devices are employed in conjunction to selectively control the pressurization and depressurization of various parts of the pneumatic system.

The use of a plurality of flow control devices in a pneumatic system adds to the cost of the system in a number of ways. Of course, there is the cost of initially fabricating the pneumatic system. This cost not only increases by the cost of the individual flow control devices, but also with the labor to install each flow control device and the increased complexity and extent of the piping loops of the pneumatic system necessary to install the valves so they will functionally cooperate with each other. Maintenance costs also increase because of the greater number of piping connections at the flow control devices which must be kept in repair and the number of control devices that will eventually have to be repaired or replaced as they deteriorate. A further expense concerns the control system for activating or operating the flow control devices. The flow control devices must function in concert with one another for efficient functioning of the pneumatic system. Therefore, the more flow control devices used in a system, the more complicated and expensive will be the control system for operating them, and the greater the cost of maintaining the control system in working order.

As mentioned above, some heretofore known pneumatic transfer systems use the low pressure side of a blower or pump to effect a low pressure or vacuum in the system. This results in entrained particulate matter being drawn into the pump which can cause undue wear to the pump. In an effort to reduce the amount of particulates being drawn into a pump, filters are often used upstream of the low pressure side of the pump. While the use of such filters does reduce the amount of particulate material being drawn into the pump, it does not eliminate all of the particulate material, and the incorporation of a filter in the system increases the cost of fabricating and maintaining the pneumatic system.

An object of the present invention is to provide a pneumatic transfer system for transferring bulk particular material to and from a bulk vessel using a single blower.

Another object of the present invention is to provide a pneumatic transfer system having a single fluid flow control device to selectively provide vacuum and pressure conditions to a bulk vessel for filling and emptying the bulk vessel, respectively.

A further object of the present invention is to provide a pneumatic transfer system to selectively provide vacuum and pressure conditions to a bulk vessel by utilizing only the pressure side of the single blower to provide both conditions.

Still a further object of the present invention is to provide a fluid flow control device adapted for use in a pneumatic transfer system as the only device required to selectively provide vacuum and pressure conditions in the system.

Yet another object of the invention is to provide a flow control device which is capable of selectively creating a pressure and vacuum condition at one fluid opening into the flow control device.

Yet a further object of the invention is to provide a flow control device which uses only a high pressure fluid source and to selectively create both the pressurized and vacuum conditions with a single mechanical action of the control device.

It is a further object of the invention to provide a gas separation filter device which is capable of withstanding fluid pressure on both of its sides and which utilizes gas flow therethrough in one direction to separate particulate material from the conveying gas and gas flow therethrough in the other direction to remove entrained particulate material from the filter device.

Other objects and advantages of the present invention will be recognized from the following description and figures in which.

Figure 1:
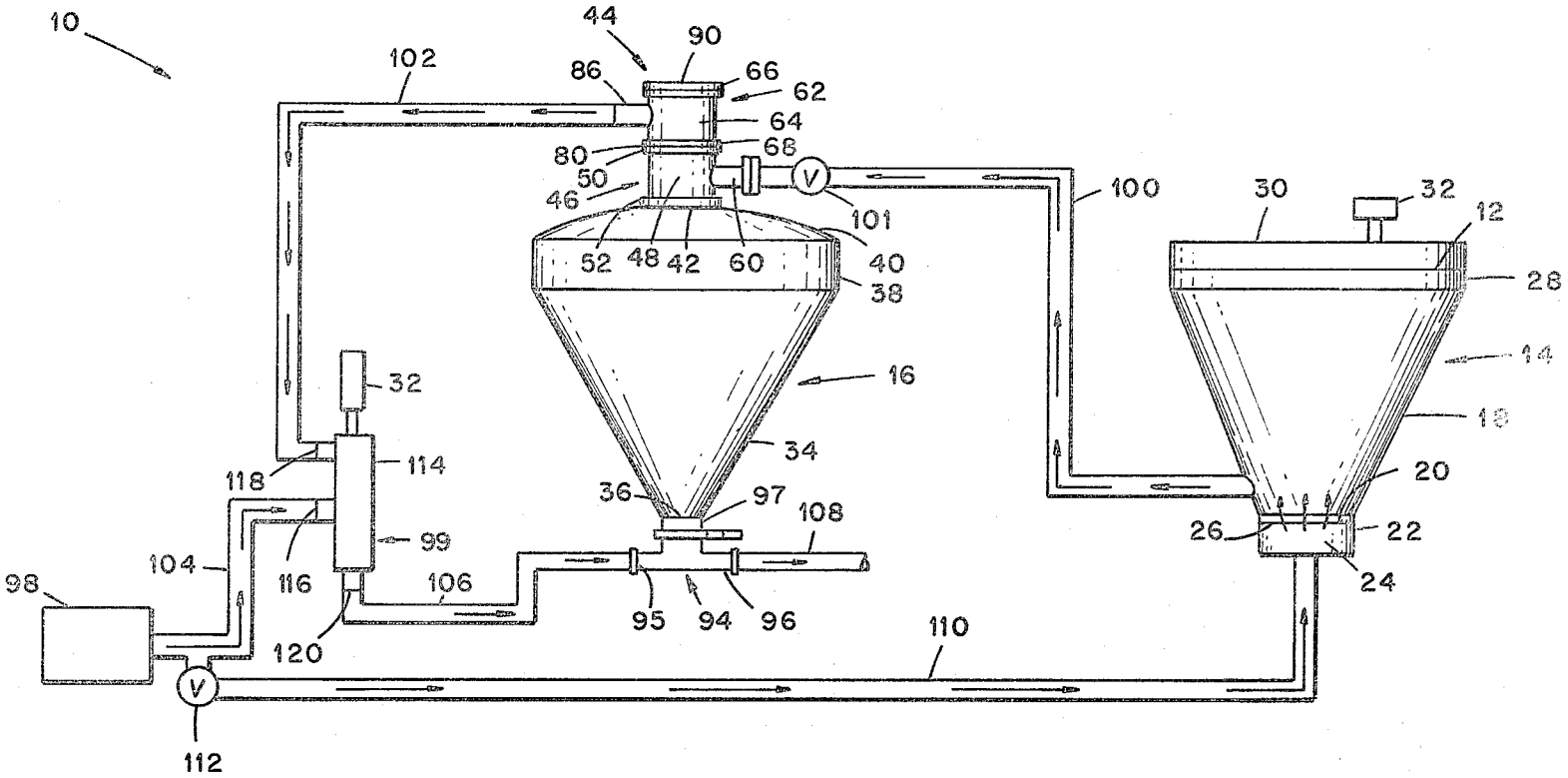
FIG. 1 is a diagramatic representation of a pneumatic transfer system in a vessel fill mode embodying various features of the present invention.

The present invention provides, among other things, a system for pneumatically transferring particulate material, alternately, to a batching vessel from a source of particulate material, and from the batching vessel to a remote location comprising a particulate material conveying conduit connecting the top section of the batching vessel with the source of particulate material for directing the flow of pneumatically entrained particulate therethrough from the source of particulate material to the batching vessel, fluid pump means having a high pressure side, a fluid flow control device having a fluid inlet, a fluid outlet, and a fluid flow-through aperture, the flow control device being adapted to selectively provide pressure and vacuum conditions through the flow-through aperture, a first pneumatic conduit interconnecting the top section of the batching vessel and the fluid flow-through aperture in the gas flow control device to provide fluid flow communication between the batching vessel and the fluid flow control device, a second pneumatic conduit interconnecting the fluid inlet into the gas flow control device and the high pressure side of the pump in fluid flow communication, and a third pneumatic conduit connecting the fluid outlet from said gas flow control device in fluid communication with the bottom section of said batching vessel.

The present invention also provides a fluid flow control device which comprises means defining a first fluid flow passageway, means defining a fluid inlet into the first fluid flow passageway, means defining a fluid outlet from the first fluid flow passageway, means defining a second fluid flow passageway in fluid flow communication with the first fluid flow passageway, means defining a fluid flow-through aperture in fluid flow communication with the second fluid flow passageway, and means adapted to define an annular restricted flow area in the first passageway so that fluid flowing in the first passageway from the fluid inlet toward the fluid outlet flows through the annular restricted flow area and is accelerated creating a low pressure zone at the location of flow communication between the first and second passageways to induce fluid flow into the fluid flow control device through the flow-through aperture, through the second passageway and into the first passageway.

A gas separation particulate matter filter device is also provided which comprises a fluid flow-through section, a sheet of flexible-expandable filter media disposed across the flow-through section, a sheet of reticulated material disposed across the flow-through section to one side of said sheet of flexible-expandable filter media to retain said filter media from bulging in the direction of the reticulated sheet as fluid flows through the filter media toward the reticulated sheet, and an open work structure disposed across the section to the other side of the sheet of filter media from the reticulated sheet to allow the flexible and expandable filter media to bulge into the interstices of the open work under the influence of a fluid stream flowing through the filter media toward the open work, thus, increasing the pore size of the filter media to facilitate back flushing of particulate matter from the pores of the filter media by the fluid stream flowing therethrough.

Figure 2:
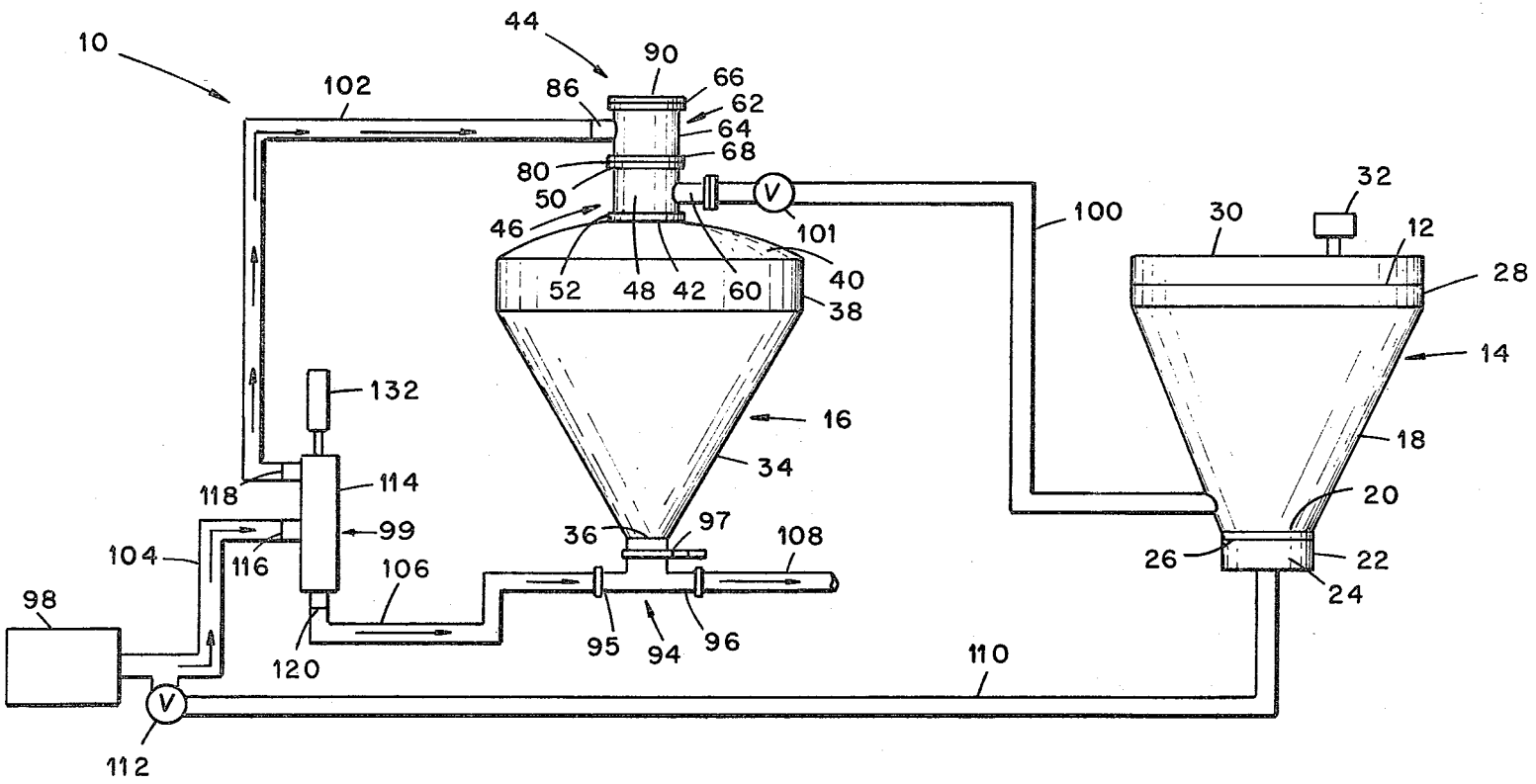
FIG. 2 is a diagramatic representation of the pneumatic transfer system of FIG. 1 in a vessel discharge mode.

The pneumatic transfer system 10 for moving particulate material from one location to another is illustrated in two different modes of operation in FIGS. 1 and 2. FIG. 1 shows the pneumatic transfer system 10 in a mode transferring bulk material 12 from, for example, a storage bin 14 to a batching vessel 16, and FIG. 2 shows the pneumatic transfer system 10 in a mode transferring the bulk material 12 from the batching vessel 16 to a remote location. Virtually any type of particulate material can be transferred by the pneumatic transfer system 10. For example, some of these materials are salt, grain, fertilizer, cement, sand and carbon.

The storage bin 14, suitable for receiving and storing particulate material 12, can be virtually any type of enclosure such as, for example, a railroad freight car, but is illustrated as a stationary storage bin having a bottom portion 18 tapered downwardly. Preferrably, the tapered bottom portion 18 is truncated to define a bottom opening 20 into the bin 14. An enclosure 22 defining a plenum chamber 24 is located at the bottom opening 20. An apertured plate 26 is located across the bottom opening 20 to divide the plenum chamber 24 from the interior of the storage bin 14. The top portion 28 of the bin 14 is provided with a removable cover 30 for loading the bin 14 with particulate material 12. The bin 14 is shown as being vented to the atmosphere through an appropriate filter device 32 in the cover 30.

The batching vessel 16 is illustrated as having a downwardly tapered bottom portion 34, preferably conical in shape, with a truncated apex defining a bottom aperture 36 into the batching vessel 16. A generally cylindrical upper section 38 extends upwardly from the conical bottom portion 34 to define the side wall of the batching vessel 16. A top portion 40 is located over the top end of the cylindrical section 38 and is provided with a generally central aperture 42.

Figure 3:
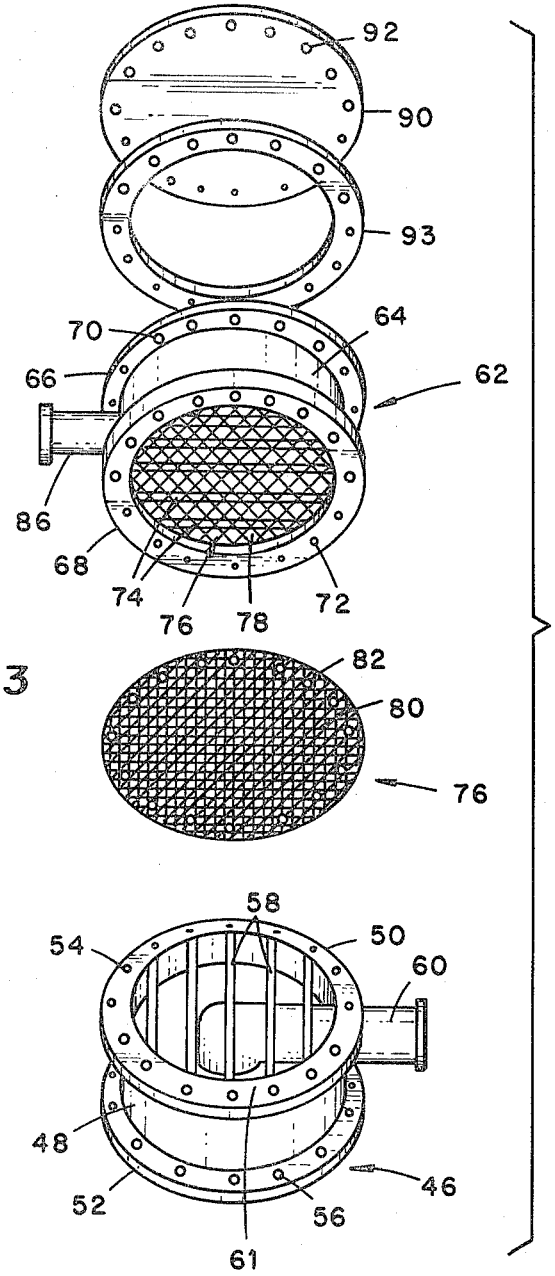
FIG. 3 is an exploded view of a portion of the vessel shown in FIGS. 1 and 2.

With continued reference to FIGS. 1 and 2 and additional reference to FIG. 3, a chamber structure 44 registers with the central aperture 42 through the top portion 40 of the batching vessel 16. The chamber structure 44 comprises an circumferential bottom section 46 coaxially located with the central aperture 42. The bottom section 46 includes a cylindrical wall 48 having a top annular flange 50 projecting radially outwardly from the upper edge of the cylindrical wall 48 and a bottom annular flange 52 projecting radially outwardly from the bottom edge of the cylindrical wall 48. The top flange 50 has a circular array of spaced holes 54 through its thickness and the bottom flange 52 has a circular array of spaced holes 56 through its thickness. An open work structure, illustrated as a plurality of spaced apart, parallel bars 58 are disposed across the cylindrical wall 48 at the top edge thereof. The bars 58 are flush with the top surface of the top annular flange 50 and are attached at their opposite ends to the circumferential wall 48. A particulate material inlet pipe 60 extends through an appropriate aperture in the cylindrical wall 48 into the circumferential bottom section 46 and is formed with a downwardly facing opening 61 to direct the conveying fluid and entrained particulate downwardly into the interior of the batching vessel. The bottom annular flange 52 of the circumferential bottom section 46 overlies the top portion 40 of the vessel 16 around the central aperture 42 and is secured in place by, for example, bolts extending through the holes 56 in the bottom annular flange 52, and through appropriate holes in the top portion 40 surrounding the central aperture 42. The chamber structure 44 further comprises a circumferential top section 62 which is coaxially located above the circumferential bottom section 46. The circumferential top section 62 includes a cylindrical wall 64 which has an top annular flange 66 radially projecting outwardly from its top edge and a bottom annular flange 68 radially projecting outwardly from its bottom edge. The top annular flange 66 has a circular array of spaced holes 70 through its thickness and the bottom annular flange 68 has a circular array of spaced holes 72 through its thickness. When the top section 62 is in place above and coaxially aligned with the bottom section 46, the bottom flange 68 of the top section 62 rests on the top flange 50 of the bottom section 46 with the holes 72 in the bottom flange 68 in registration with the holes 54 in the top flange 50. The top section 62 is secured to the bottom section 46 by bolts which extend through the registered holes 72 and 54. The top section 62 also includes an open work structure illustrated as a plurality of spaced apart, parallel bars 74 disposed across the cylindrical wall 64 near the bottom edge thereof. The bars 74 are spaced inwardly in the direction of the longitudinal axis of the top section 62 from the bottom surface of the bottom flange 68 and are attached at their opposite ends to the cylindrical wall 64. Thus, when the top circumferential section 62 is attached to the bottom circumferential section 46, the plane of the bars 74 in the top section 62 is parallel and spaced apart from the plane of the bars 58 in the bottom section 46.

Figure 4:
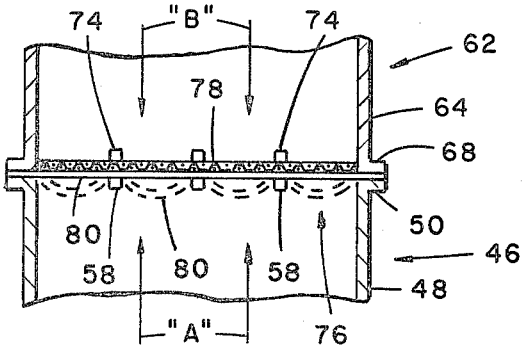
FIG. 4 is an enlarged cross-section view of a filter assembly useful in the pneumatic transfer system.

A filter assembly 76 (FIGS. 3 and 4) is disposed between the top section 62 and the bottom section 46 of the chamber structure 44. The filter assembly 76 comprises a reticulated sheet 78 which is fluid pervious and a layer of gas separation filter media 80. The reticulated sheet 78 is generally circular in peripheral shape and is adapted to fit into and across the circumferential top section 62 of the chamber structure 44 parallel to the plane of the bars 74 and in abuttment with bars 74 in the space between the bars 74 and the bottom surface of the bottom annular flange 68 of the cylindrical wall 64. The layer of filter media 80 is also circular in peripheral shape and has substantially the same diameter as the top annular flange 50 of the circumferential bottom section 46. The filter media 80 includes a circular array of spaced holes 82 about its periphery which match the circular array of holes 54 in the top annular flange 50 of the circumferential bottom section 46. The filter media is fabricated of a flexible and expandable material, such as for example a polyester, and has a pore size which will allow fluid to pass through with a minimum pressure drop, but will not allow the particulate material to pass through. The filter media 80 is located across the flow-through cross-secton of chamber structure 44, which serves as a flow-through filter frame, between the top flange 50 of the circumferential bottom section 46 and the bottom flange 68 of the circumferential top section 62 with the holes 82 of the filter media 80 in registration with the holes 54 and 72 through the top flanges 50 and bottom flange 68, respectively, so that the bolts anchoring the bottom section 46 to the top section 62 of the chamber enclosure 44 will pass through the holes 82 in the filter media 80. Thus, the filter media 80 is captured between the top and bottom flanges 50 and 68, respectively.

A fluid pipe 86 passes through the cylindrical wall 64 of the top section 62 through which the batching vessel 16 can be pressurized or evacuated.

The top of the chamber structure 44 is closed by means of a cover plate 90 which is generally circular in peripheral shape and of substantially the same diameter as the top annular flange 66 of the circumferential top section 62. The cover plate 90 is formed with a circular array of holes 92 which match the circular array of holes 70 in the top flange 66. The cover plate 90 rests on the top flange 66 with its holes 92 in registration with the holes 70 in the top flange 66 and is anchored in place by, for example, bolts which pass through the registered holes 92 and 70. A gasket 93 is located between the cover plate 90 and top annular flange 66 of the top section 62 to prevent gas leakage therebetween.

A material discharge header 94 (FIGS. 1 and 2) is connected to the bottom portion 34 of the batching vessel 16 over the bottom aperture 36 into the batching vessel. The material discharge header 94 has a conveying fluid inlet branch 95 and a oppositely disposed discharge branch 96 suitable to convey entrained particulate material from the bottom portion of the batching vessel 16. The material discharge header 94 includes a valve 97 for opening and closing the bottom aperture 36 for allowing and preventing the flow of particulate material out of the batching vessel and into the discharge header.

The pneumatic system 10 comprises a fluid pump or a blower 98, a fluid flow control device 99, and conduits functionally interconnecting the blower 98, fluid flow control device 99, storage bin 14 and batching vessel 16 for selectively, pneumatically transferring particulate material 12 from the storage bin 14 to the batching vessel 16, and pneumatically transferring particulate material from the batching vessel to a remote location.

A particulate material conveying conduit 100 interconnects the material inlet pipe 60 into the bottom section 46 of the chamber structure 44 with the interior of the storage bin 14 at the conical bottom portion 18 above the apertured plate 26. This material conveying conduit 100 will pneumatically convey particulate material 12 from the storage bin 14 to the batching vessel 16. A valve 101 is located in the material conveying conduit 100 to regulate the flow of material through this conduit from the storage bin to the batching vessel. A first pneumatic conduit 102 interconnects the fluid flow control device 99 with the main fluid pipe 86 to convey fluid to and from the interior of the chamber structure 44 to alternatively create a vacuum and pressurize conditions in the batching vessel. The pressure side of the blower 98 is pneumatically interconnected to the fluid flow control device 99 by a second pneumatic conduit 104 to convey pressurized fluid to the fluid flow control device 99. The valved material discharge header 94 at the bottom aperture 36 in the bottom of the batching vessel 16 has its fluid inlet branch 95 in fluid communication, through a third pneumatic conduit 106, with the fluid flow control device 99. Pressurized fluid from the blower 98 passes through the fluid flow device 99 to the discharge header 94 through the third pneumatic conduit 106 to entrain particulate material 12 falling out of the batching vessel 16 into the discharge header 94. The particulate material 12 flowing from the batching vessel 16 into the discharge header 94 through the bottom aperture 36 is entrained in the fluid passing through the discharge header 94 and is pneumatically conveyed to a remote location through a material discharge conduit 108 which is connected to the discharge branch 96 of the discharge header 94 opposite to the connection of the third pneumatic conduit 106 to the fluid inlet branch 95 of the discharge header 94. To enhance the flow of particulate material from the storage bin 14 through the material conveying conduit 100 to the batching vessel 16, the particulate material 12 in the storage bin is at least partially fluidized by the introduction of pressurized fluid into the storage pin. This fluidization is accomplished by interconnecting the pressure side of the blower 98 to plenum chamber 24 by means of a fourth pneumatic conveying conduit 110. One end of the fourth conduit 110 is connected at the pressure side of the blower 98 and the other end is connected at the plenum chamber 24 below the bottom opening 20 into the storage bin 14 on the other side of the apertured plate 26 from the connection of the material conveying conduit 100. A valve 112 in the fourth pneumatic conduit 110 controls the flow of fluid from the blower 98 through the fourth conduit 110 to the plenum chamber 24 and into the storage bin 14.

Figure 5:
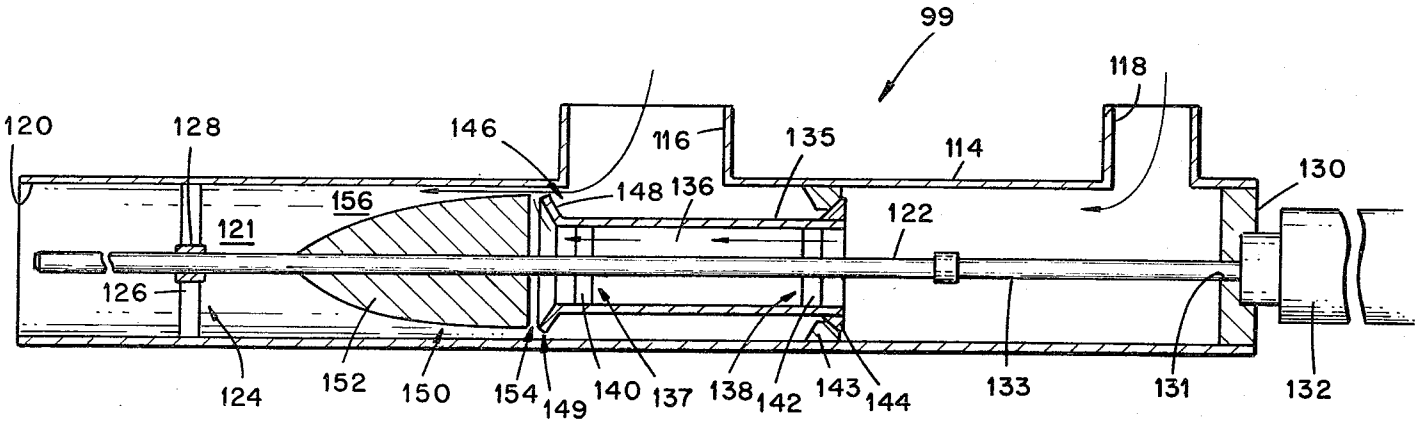
FIG. 5 is an enlarged longitudinal cross-sectioned view of a fluid flow control device embodying various features of the present invention in one mode of operation.
Figure 6:
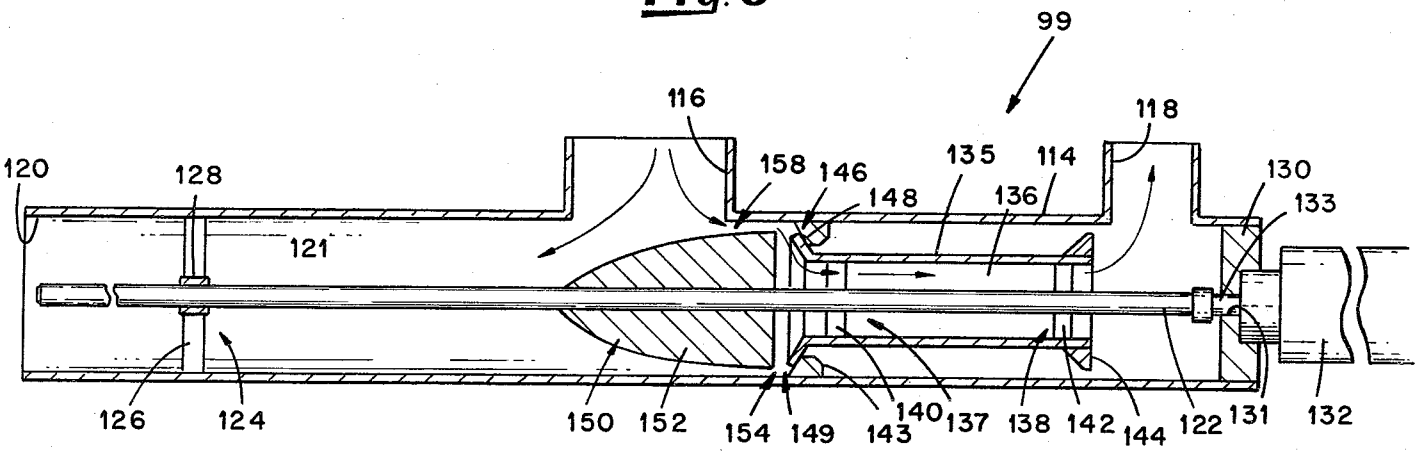
FIG. 6 is an enlarged longitudinal cross-sectioned view similar to that of FIG. 5, but showing the fluid flow control device in another mode of operation; and, FIG. 7 is an enlarged longitudinal cross-sectioned view of another advantageous embodiment of a fluid flow control device embodying various features of the present invention.

With reference to FIGS. 5 and 6, the fluid control device 99 is shown as comprising a generally cylindrical housing 114. A fluid inlet aperture 116 is formed through the cylindrical wall of the housing 114 and a fluid flow-through aperture 118 is formed through the cylindrical wall of the housing 114 spaced longitudinally of the housing 114 from the fluid inlet aperture 116. A fluid outlet aperture 120 is formed at one end of the cylindrical housing 114 most adjacent the fluid inlet aperture 116 so that the housing 114 defines a first fluid flow passageway 121 from the inlet aperture 116 to the outlet aperture 120. An elongated shaft 122 is coaxially disposed in the housing 114 and is mounted therein for longitudinal movement by means, for example, a spider construction 124 which is located between the fluid outlet aperture 120 and fluid inlet aperture 116. The spider construction 124 has radially extending webs 126 and includes a bearing 128 coaxially located with the housing 114. The other end of the housing 114 opposite the fluid outlet aperture 120 is closed by an end cap 130. The end cap 130 is formed with an bore 131 coaxial with the housing 114 and, therefore, coaxial with the bearing 128. A pneumatic or hydraulic cylinder device 132 is mounted to the end cap 130 of the housing 114 so that its piston rod 133 projects through the bore 131 and coaxially extends into the housing 114. The elongated shaft 122 is attached at one of its ends to the end of the piston rod 133 of the hydraulic cylinder device 132 and is supported in the bearing 128 of the spider construction 124. The elongated shaft 122 is reciprocally movable in the bearing 128 by the piston rod 133 of the hydraulic cylinder device 132 back and forth longitudinally in the housing 114. It should be noted that the spider construction 124 provides support for the shaft 122 and also allows the flow of fluid between the webs 126 in the first fluid flow passageway 121 from the fluid inlet aperture 116 to the fluid outlet aperture 120. A cylindrical tube 135, smaller in diameter than the housing 114 and shorter than the distance separating the fluid inlet aperture 116 from the fluid flow through aperture 118 is concentrically located in the housing 114 and is attached to the shaft 122 for longitudinal movement with the shaft 122 between a first position (FIG. 5) and a second position (FIG. 6). The cylindrical tube 135 defines a second fluid flow passageway 136. When the cylindrical tube 135 is in the first position, the second fluid flow passageway 136 provides for fluid flow from the fluid flow-through aperture 118 to the first fluid flow passageway 121, and when the cylindrical tube 135 is in the second position the second fluid flow passageway 136 provides for fluid flow from the fluid inlet aperture 116 to the fluid flow-through aperture 118. The cylindrical tube 135 is illustrated as being attached to the shaft 122 by means of two spider constructions 137 and 138. One spider construction 137 is located near the end of the tube 135 most adjacent the fluid flow inlet aperture 116. The spider construction 137 is formed of radial webs 140, each attached at one of its ends to the interior wall surface of the tube 135 and at the other of its ends to the shaft 122. The other spider construction 138 is located near the end of the tube 135 most adjacent the fluid flow-through aperture 118 and is formed of radial webs 142, each attached at one of its ends to the interior wall surface of the tube 135 and at the other of its ends to the shaft 122. The spider constructions 137 and 138 provide support for the tube 135 and also allow the flow of fluid through the second fluid flow passageway 136 defined by the tube 135 past th webs 140 and 142, respectively, between the fluid inlet aperture 116 and fluid flow-through aperture 118. A annular sealing seat 143 is located between the fluid inlet aperture 116 and the fluid flow-through aperture 118, and is attached to the cylindrical wall of the cylindrical housing concentrically with the housing, and the end of the tube 135 most adjacent the fluid flow-through aperture 118 includes an annular seal 144 surrounding the periphery of the tube 135. Both the annular sealing seat 143 and annular seal 144 have a bevel at their mating faces of, for example, about 45°. When the tube 135 defining the second fluid passageway 136 is in the first position (FIG. 5) moved longitudinally of the housing 114 toward the fluid outlet aperture 120 the beveled face of the annular seal 144 contacts and creates a fluid tight seal with the beveled face of the annular sealing seat 143. The mating beveled faces of the annular sealing seat 143 and annular seal 144 also coact to coaxially center the tube 135 within the cylindrical housing 114. The other end of the tube 135, i.e., the end most adjacent the fluid inlet aperture 116 includes a fluid flow restrictor section 146 which is illustrated as an annular flange 148 projecting in a generally radial direction outwardly of the tube 135 toward the cylindrical wall of the cylindrical housing 114. The annular flange 148 is also dished shaped in cross-section to protrude generally longitudinally outwardly from the end of the tube 135 at which it is located. The outside diameter of the annular flange 148 is smaller than the inside diameter of the housing 114 so that when the tube 135 is in the first position (FIG. 5) moved longitudinally toward the fluid outlet aperture 120 with the annular seal 144 at one end of the tube 135 in fluid sealing contact with the annular sealing seat 143, the circumferential margin of the annular flange 148 cooperates with the cylindrical wall of the cylindrical housing 114 to define an annular restricted fluid flow area 149 in the first fluid flow passageway 121 between the fluid inlet aperture 116 and fluid outlet aperture 120. The dished shape of the annular flange 148 provides a smooth lead into the restricted fluid flow area 149 for fluid flowing in the first fluid passageway 121 from the fluid inlet aperture 116 to the fluid outlet aperture 120. When the tube 135 is in the second position (FIG. 6) moved longitudinally of the housing 114 toward the fluid flow-through aperture 118, the annular seal 144 at one end of the tube 135 is displaced from the annular sealing seat 143 and is located adjacent the fluid flow-through aperture 118 between the fluid flow-through aperture 118 and fluid inlet aperture 116. A fluid flow transition means, generally denoted by the numeral 150, is located near that end of the tube 135 having the annular flange 148. The transition means 150 is illustrated as a bullet shaped body 152 attached coaxially to the shaft 122 for movement with the shaft 122 and with the tube 135. The bullet shaped body 152 is oriented relative to the tube 135 so that is tapers longitudinally of the cylindrical housing 114 in a direction away from that end of the tube 135 having the annular flange 148. The bullet shaped fluid transition body 152 is also spaced from that end of the tube 135 having the annular flange 148 in a longitudinal direction of the tube 135 to define an annular fluid path 154 between it and annular flange 148. The annular fluid path 154 provides fluid flow communication between the first and second fluid flow passageways 121 and 136, respectively.

Figure 7:
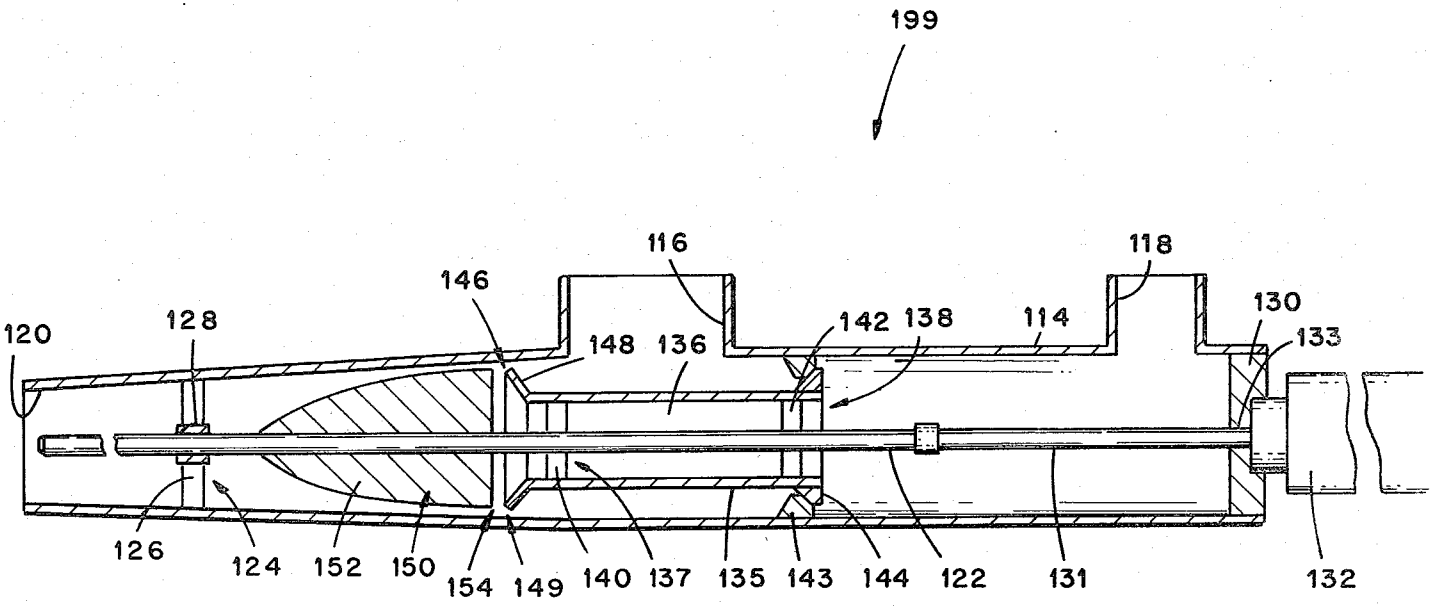

A somewhat modified version of a flow control device 199 is shown in FIG. 7. In this version, the portion of the housing 114 defining the first fluid flow passageway tapers from the fluid flow inlet aperture 116 toward the fluid flow outlet aperture 120 so that a converging first fluid flow passageway 221 is defined. Thus, by moving the cylindrical tube 135 and transition means 150 into and out of the first converging fluid flow passageway 221 to different extents, the size of the annular restricted fluid flow area 149 is changed. As the cylindrical tube 135 is moved axially further into the converging first fluid flow passageway 221 the area of the annular restricted fluid flow area 149 will decrease because the circumferential margin of the annular flange 148 will be closer to the cylindrical wall of the housing 114. Likewise, as the cylindrical tube 135 is moved axially further out of the converging first fluid flow passageway 221 the area of the annular restricted fluid flow area 149 will increase because the circumferential margin of the annular flange 148 will be further away from the cylindrical wall of the housing 114. Therefore, the fluid flow control device 199 is adjustable to obtain different volume rates of flow through the annular fluid path 154 as the pressure drop across the annular restricted fluid flow area 149 changes with changes in size of the annular area 149.

In evacuating a vessel, initially a large volume rate of flow of fluid must be removed to begin to create a vacuum condition in the vessel. However, as the vacuum condition in the vessel increases, there is obviously less fluid to be removed to further increase the vacuum, and it is succeedingly more difficult to remove this lessening amount of remaining fluid. That is, it requires a greater pressure drop to pull this lessening amount of fluid from the vessel. The flow control device 199 allows the restricted fluid flow area 149 to be decreased as the vacuum condition in the vessel being evacuated increases to provide the required greater pressure drop to asperate the lessening amount of fluid out of the vessel.

When the fluid flow control device 99 and 199 is incorporated in the pneumatic transfer system 10, the first pneumatic conduit 102 is connected in fluid communication with the fluid flow-through aperture 118 of the control device 99, the second pneumatic conduit 104 is connected in fluid flow communication with the fluid inlet aperture 116 of the control device 99, and the third pneumatic conduit 106 is connected in fluid flow communication with the fluid outlet aperture 120 of the control device 99.

Preparatory to the filling operation it is desirable to create an initial vacuum in the batching vessel 16. In order to create this initial vacuum condition, the valve 101 in the material converging conduit 100 is closed to prevent flow communication between the storage bin 14 and batching vessel 16, the valve 112 at the blower 98 in the fourth pneumatic conduit 110 is closed to prevent fluid flow communication between the blower 98 and the storage bin 14, and the valved material discharge header 94 at the bottom of the batching vessel 16 is closed to prevent fluid flow communication with the interior of the batching vessel 16. The cylindrical tube 135 defining the second fluid passageway 136 in the fluid flow control device 99 is moved by the pneumatic cylinder device 132 to its first position (see FIG. 5). Fluid under pressure passes from the high pressure side of the blower 98 through the second pneumatic conduit 104 from the high pressure side of the blower 98 and into the cylindrical housing 114 of the fluid control device 99 through the fluid inlet aperture 116. The pressurized fluid flowing through the inlet aperture 116 into the cylindrical housing 114 is forced to flow through the annular restricted fluid flow area 149 defined between the periphery of the annular flange 148 and cylindrical wall of the cylindrical housing 114 in the first fluid flow passageway 121. The pressurized fluid has no other course of travel within the cylindrical housing 114 because of the fluid tight seal created by the annular sealing seat 143 and annular seal 144 at the other end of the tube 135 between the fluid inlet aperture 116 and fluid flow-through aperture 118. As the pressurized fluid passes through the annular restricted flow area 149 it is accelerated creating a low pressure zone at the annular fluid path 154 defined between the bullet shaped body 152 and annular flange 148. The low pressure zone created at the annular fluid path 154 asperates fluid from the batching vessel 16 through the first pneumatic conduit 102 and into the flow control device through the flow-through aperture 118 creating a reduced pressure or a partial vacuum condition in the batching vessel 16. Thus, when the tube 135 defining the second fluid passageway 136 is in the first position, the flow control device 10 functions in the manner of an eductor.

The following discussion concerning the functioning of the pneumatic transfer system 10 and fluid control device 99 during the process of filling the batching vessel 16 with particulate material from the storage bin 14 can best be followed by referring to FIGS. 1 and 5. To initiate the filling process, with the blower 98 still operating and the cylindrical tube 135 of the fluid flow control device 99 remaining in its first position, the valve 101 in the material converging conduit 100 and the valve 112 in the fourth pneumatic conduit 110 are simultaneously opened to establish flow communication between the storage bin 14 and the batching vessel 16, and to establish flow communication between the blower 98 and storage bin 14. As represented by the flow arrows in FIGS. 1 and 5, fluid under pressure passes from the high pressure side of the blower 98 through the fourth conduit 110 to the storage bin 14 as well as continuing to flow through the second pneumatic conduit 104 into the cylindrical housing 114 of the fluid flow control device 99 through the fluid inlet aperture 116. The pressurized fluid moves from the fourth pneumatic conduit 110 into the plenum chamber 24 and through the apertured plate 26 separating the plenum chamber 24 from the interior of the storage bin in a plurality of streams into the interior of the storage bin 14 at least partially fluidizing the particulate material 12 in the bin 14 near the connection of the material converging conduit 100 to the bin 14 and pressurizing the bin 14.

The reduced pressure inside the batching vessel 16, relative to the higher pressure in the storage bin 14, causes the fluidized particulate material in the storage bin 14 to become entrained in the fluid moving from the storage bin 14 to the batching vessel 16 through the material conveying conduit 100. As previously mentioned, it is desirable to create a vacuum condition in the batching vessel 16 before initiating the filling operation. With a vacuum condition existing in the batching vessel 16, as soon as the valve 101 in the material conveying conduit 100 is opened establishing flow communication between the storage bin 14 and batching vessel 16, particulate material will begin to move in the conduit 100 from the bin 14 to the batching vessel 16. Thus, the operation of filling the batching vessel 16 is sped up because no time is consumed waiting for a vacuum condition to be created in the batching vessel 16 after the valve 101 is opened.

Inside the flow control device 99, the asperated fluid from the batching vessel 16 flows from the flow-through aperture 118 through the second fluid flow passageway 136 defined by the tube 135, and out of the second fluid flow passageway 136 through the annular fluid path 154 into the low pressure zone at the annular restricted flow area 149 where it co-mingles with the fluid flowing from the inlet aperture 116. The co-mingled fluid flows in the first fluid flow passageway 121 past the bullet shaped body 152 of the transition means 150 toward the fluid outlet aperture 120 from the fluid flow control device 99. The transition means 150 cooperates with the cylindrical wall of the housing 114 to define an annular diverging zone 156 therebetween downstream of the low pressure zone which functions in the manner of a diverging nozzle to allow the co-mingled fluid to gradually decelerate without forming eddys and vortices as it fills the cross-sectional area of the first fluid flow passageway 121 in the cylindrical housing 114 downstream of the restricted flow area 149. The co-mingled fluid flows through the outlet aperture 120 of the fluid flow control device 99 and through the third pneumatic conduit 106 past the closed valve of the material discharge header 94. Because the valved discharge header 94 is closed, no particulate material is removed from the batching vessel 16.

It should be noted that the particulate material 12 entering the batching vessel 14 from the material conveying conduit 100 enters the circumferential bottom section 46 of the chamber structure 44 below the filter media 80 and that the conveying fluid from the batching vessel 16 passes upwardly through the filter media 80 (as denoted by the arrows A in FIG. 4) before entering the first pneumatic conduit 102. Thus, the particulate material 12 is separated from the conveying fluid and is not carried through the first pneumatic conduit 102 to the fluid flow control device 99. The reticulated sheet 78 functions as a filter media retainer so that the filter media 80 will not bulge out in the direction of fluid flow preventing an increase in pore size of the filter media which could allow particulate material to pass through it.

The following discussion of the discharging of particulate material 12 from the batching vessel 16 will be easily followed by referring to FIGS. 2 and 6. The tube 135 defining the second fluid passageway 136 of the fluid flow control device 99 is moved by the pneumatic cylinder device 132 to the second position (FIG. 6) toward the fluid flow-through aperture 118. The valve 101 in the material conveying conduit 100 is closed, thus closing communication between the batching vessel 16 and storage vessel 14 through the conduit 100, the valve 112 at the high pressure side of the blower 98 in the fourth pneumatic conduit 110 is also closed so that no fluid will pass through the fourth conduit 110 to the storage bin 14, and the valve of valved material discharge header 94 is opened to allow the particulate material 12 in the batching vessel 16 to empty through the aperture 36 into the discharge header 94. As represented by the flow arrows in FIGS. 2 and 6, fluid under pressure passes from the high pressure side of the blower 98 through the second pneumatic conduit 104 and into the cylindrical housing 114 of the fluid control device 99 through the fluid inlet aperture 116. The pressurized fluid flowing into the fluid flow control device 99 is divided into two counter-current paths. Therefore, when the tube 135 defining the second fluid passageway 136 is in the second position, the flow control device 99 functions in the manner of a flow divider. One path passes through the annular fluid path 154 into the second fluid flow passageway 136 defined by the tube 135, and out of the tube 135 at the opposite end thereof through the fluid flow-through aperture 118 into the first pneumatic conduit 102 to pressurize the batching vessel 16. When the tube 135 is in the second position, the bullet shaped body 152 of the transition means 150 cooperates with the cylindrical wall of the cylindrical housing 114 to define an annular converging zone 158 therebetween upstream of the annular fluid path 154. The annular converging zone 158 functions in the manner of a converging nozzle to smoothly accelerate the fluid passing therethrough toward the annular fluid path 154. The other path of pressurized fluid passes from the fluid inlet aperture 116 and into the first fluid flow passageway 121 defined by the cylindrical housing 114 and moves toward the fluid outlet aperture 120. The fluid flowing in the first fluid passageway 121 passes from the fluid control device 99 through the fluid outlet aperture 120 and into the third pneumatic conduit 106 to the discharge header 94. The pressurized fluid in the first pneumatic conduit 102 enters the fluid pipe 86 in the cylindrical top section 62 of the chamber enclosure 44 above the reticulated sheet 78 and filter media 80. This pressurized fluid flows downwardly through the reticulated sheet 78 and filter media 80 into the batching vessel 16, thus, pressurizing the batching vessel 16. The pressurized fluid flowing through the outlet aperture 120 from the fluid flow-control device 99 and in the third pneumatic conduit 106 passes through the inlet branch 95 into the material discharge header 94 beneath the aperture 36 at the bottom of the batching vessel 16. The force of gravity acting on the particulate material, and fluid pressure in the batching vessel 16 above the batch of particulate material cooperate to efficiently empty particulate material from the batching vessel through the aperture 36 and into discharge header 94. The particulate material in the discharge header 94 becomes entrained in the pressurized fluid stream and is carried from the material discharge header 94 through the discharge branch 96 and through the material discharge conduit 108 to a remote location.

It should be noted that the pressurizing fluid flowing from the first pneumatic conduit 102 into the batching vessel 16 enters the top section 64 of the chamber 44 above the filter media 80 and passes downwardly through the filter media 80 (as denoted by the arrows B in FIG. 4) before entering the batching vessel 16. The recirculated sheet 78 functions to disburse fluid flow stream over the face of the filter media 80 and dissipate the kinetic energy of the pressurized fluid before the pressurized fluid contacts the filter media 80 so that the filter media will not be destroyed by the high pressure fluid. Also, the pressurized fluid passing through the flexible-expandable filter media 80 will cause the filter media 80 to bulge downwardly, as depicted by the dashed lines in FIG. 4, between the bars 58 in the bottom section 46 of the chamber 44. This will result in expanding the pore size of the filter media so that particulate material which may be caught in the pores can be easily back flushed by the vessel pressurizing fluid entering from the first pneumatic conduit 102.

The foregoing detailed description is given primarily for clearness of understanding and no unnecessary limitations are to be understood therefrom, for modifications will become obvious to one skilled in the art upon reading this disclosure and may be made without departing from the spirit of the invention or scope of the appended claims.

What is claimed is:

1. A fluid control device, comprising:

means defining a first fluid flow passageway;

means defining a fluid inlet into said first fluid flow passageway;

means defining a fluid outlet from said first fluid flow passageway;

means defining a second fluid flow passageway mounted for movement between a first position and a second position, said second fluid flow passageway being in fluid communication with said first fluid flow passageway when said second fluid flow passageway is in the first position and when said second fluid flow passageway is in the second position;

means defining a fluid flow-through aperture in fluid flow communication with said second fluid flow passageway;

means adapted to define an annular restricted flow area in said first passageway when said second fluid flow passageway is in the first position so that fluid flowing in said first fluid flow passageway from said fluid inlet toward said fluid outlet flows through said annular restricted flow area and is accelerated creating a low pressure zone at the location of flow communication between said first and second fluid flow passageways to induce fluid flow from said flow-through aperture through said second fluid flow passageway and into said first passageway;

said annular restricted flow area defining means being removed from cooperation with said first fluid flow passageway defining means when said second fluid flow passageway is in the second position so that the low pressure zone is not created at the location of flow communication between said first and second fluid flow passageways; and said means defining a second fluid flow passageway being operable when moved to the second position to define at least two flow paths so that fluid flowing into the flow control device through said fluid inlet is divided into at least the two flow paths, one path being through said first fluid flow passageway to said fluid outlet and the other path being through said second fluid flow passageway to said flow-through aperture.

2. The fluid flow control device of claim 1, further comprising:

transition means associated with said second fluid flow defining means for movement therewith between the first and second positions such that when said second fluid passageway defining means is in the first position said transition means cooperates with said first fluid flow defining means to define an annular diverging zone in said first fluid flow passageway downstream of said annular restricted flow area to provide a smooth transition for the fluid flowing from said annular restricted area toward said fluid outlet from said first fluid passageway, and when said second fluid passageway defining means is in the second position said transition means cooperates with said first fluid passageway defining means to define an annular converging zone upstream of the location of fluid flow communication between said first and second fluid passageways to provide a smooth flow of fluid into said second fluid passageway from said fluid inlet.

3. The fluid flow control device of claim 2 wherein said transition means is spaced from one end of said second fluid passageway defining means to define therebetween the location of fluid communication between said first and second fluid flow passageways.

4. A fluid control device comprising:

means defining a first fluid flow passageway;

means defining a fluid inlet into said first fluid flow passageway;

means defining a fluid outlet from said first fluid flow passageway means defining a second fluid flow passageway mounted for movement between a first position and a second position, said second fluid flow passageway being in fluid communication with said first fluid flow passageway when said second fluid flow passageway is in the first position and when said second fluid flow passageway is in the second position;

means defining a fluid flow-through aperture in fluid flow communication with said second fluid flow passageway;

means adapted to define an annular restricted flow area in said first passageway when said second fluid flow passageway is in the first position so that fluid flowing in said first fluid flow passageway from said fluid inlet toward said fluid outlet flows through said annular restricted flow area and is accelerated creating a low pressure zone at the location of flow communication between said first and second fluid flow passageways to induce fluid flow from said flow-through aperture through said second fluid flow passageway and into said first passageway;

said annular restricted flow area defining means being removed from cooperation with said first fluid flow passageway defining means when said second fluid flow passageway is in the second position so that the low presssure zone is not created at the location of flow communication between said first and second fluid flow passageways;

said means defining a second fluid flow passageway being operable when moved to the second position to define at least two flow paths so that fluid flowing into the flow control device through said fluid inlet is divided into at least the two flow paths, one path being through said first fluid flow passageway to said fluid outlet and the other path being through said second fluid flow passageway to said flow-through aperture;

an annular sealing seat located in said flow control device between said fluid inlet and said fluid flow-through aperture; and an annular seal associated with said second passageway defining means which contacts said annular sealing seat when said second passageway defining means is in the first position creating a fluid tight seal therebetween.

5. A fluid flow control device comprising:

an exterior cylinder;

an inlet aperture formed in said exterior cylinder for allowing fluid flow into said exterior cylinder;

an interior cylinder having first and second ends, having a smaller diameter than said exterior cylinder, and being disposed coaxially within and spaced-apart from said exterior cylinder;

meams for supporting said interior cylinder generally coaxially within said exterior cylinder for movement between a first position and a second position;

an annular flow restrictor disposed on the first end of said interior cylinder and extending outwardly therefrom to define an annular restricted flow area in the exterior cylinder and on one side of said inlet aperture;

means for forming a seal between the second end of said interior cylinder and said exterior cylinder on the opposite side of said inlet aperture from said annular restricted flow area when said interior cylinder is in the first position, so that fluid introduced into said inlet aperture flows through said annular restricted flow area and is accelerated creating a low pressure zone adjacent to the first end of said interior cylinder to induce fluid flow in said interior cylinder from its second end to its first end when said interior cylinder is in the first position; and said annular flow restrictor being disposed within said exterior cylinder in a position that does not create an annular restricted flow area when said interior cylinder is in the second position.

6. The fluid flow control device of claim 5 wherein said interior cylinder is disposed entirely on one side of said inlet aperture when said interior cylinder is in the second position.

7. The fluid flow control device of claim 5, further comprising a means for forming a seal between said interior cylinder and said exterior cylinder when said interior cylinder is in the second position.

8. The fluid flow control device of claim 5 wherein said annular flow restrictor comprises an annular dish-shaped flange attached to said first end of said interior cylinder extending radially outwardly and away from said first end of said interior cylinder.

9. The fluid flow control device of claim 5 further comprising an annular sealing seat attached to the interior of said exterior cylinder being disposed and dimensioned to engage said annular flow restrictor so that a seal is formed when said interior cylinder is in the second position.

10. The fluid flow control device of claim 5 further comprising a tapered bullet mounted generally coaxially within said exterior cylinder adjacent to the first end of said interior cylinder for operating cooperatively with said exterior cylinder to define an annular diverging zone when the interior cylinder is in the first position so that a smooth transition is provided for the fluid flowing from the annular restricted area, said bullet acting cooperatively with said exterior cylinder to define an annular converging zone when said interior cylinder is in the second position for fluid flowing into said inlet aperture and into said second end of said interior cylinder.

11. The fluid flow control device of claim 5, further comprising a tapered bullet mounted generally coaxially within said exterior cylinder spaced-apart from the first end of said interior cylinder at a fixed distance in both the first and second positions of the interior cylinder.

* * * * *